US007534073B2

(12) United States Patent
Stahm

(10) Patent No.: US 7,534,073 B2
(45) Date of Patent: May 19, 2009

(54) EARTH ANCHOR

(76) Inventor: William G. Stahm, 14884 N. Jackson St., Brighton, CO (US) 80602

( * ) Notice: Subject to any disclaimer, the term of this patent is extended or adjusted under 35 U.S.C. 154(b) by 56 days.

(21) Appl. No.: 11/803,138

(22) Filed: May 14, 2007

(65) Prior Publication Data

US 2008/0282625 A1 Nov. 20, 2008

(51) Int. Cl.
*E02D 5/80* (2006.01)

(52) U.S. Cl. ..... 405/259.1; 52/163; 52/155

(58) Field of Classification Search ..... 405/259.1, 405/258.1; 52/162, 163, 165, 156, 155
See application file for complete search history.

(56) References Cited

U.S. PATENT DOCUMENTS

| | | | | |
|---|---|---|---|---|
| 4,044,513 | A | 8/1977 | Deike | |
| 4,096,673 | A | 6/1978 | Deike | |
| 4,802,317 | A * | 2/1989 | Chandler | 52/163 |
| 5,775,037 | A | 7/1998 | James | |
| 6,237,289 | B1 | 5/2001 | Jewett et al. | |
| D572,546 | S * | 7/2008 | Stahm | D8/1 |

FOREIGN PATENT DOCUMENTS

| | | |
|---|---|---|
| EP | 0 313 936 | 5/1989 |
| EP | 0 863 261 | 9/1998 |
| GB | 2 283 510 | 5/1995 |
| GB | 2 283 511 | 5/1995 |
| GB | 2 398 808 | 9/2004 |
| WO | WO95/12771 | 5/1995 |

OTHER PUBLICATIONS

Photograph from website showing Fast Plant product from Italy www.fast-system.it.
Printout of website showing applicant's Manta Ray Earth Anchor Systems www.earthanchor.com/mantaprod.html.
Printout of website showing applicant's Duckbill Anchors www.earthanchor.com/duckprod.html.
Printout of Platipus Anchors website showing the Platipus earth anchors www.platipus-anchors.com/earth_anchoring_systems/.

* cited by examiner

*Primary Examiner*—Frederick L Lagman
(74) *Attorney, Agent, or Firm*—The Hill Firm; Dennis A. Gross

(57) ABSTRACT

An earth anchor of the pivoting type having an essentially cylindrical body, a blind bore extending therein to from a trailing axial end of the cylindrical body and a leading edge projecting from a leading end of the body, the leading edge chisel shaped for ease of penetration into the ground, guiding surfaces extending substantially normal to the leading edge and forward of the main body portion, the guiding surfaces having a plurality of leading chisel edges stepped back from the leading edge and from one another as the guiding surface leading edges are spaced further away from a center of the leading edge, the guiding surfaces terminating in final leading edge spaced axially from the leading edge and laterally from each of the stepped leading edges and having at least a portion which extend radially beyond the main body, guide ridges extending from the final leading edges to the trailing axial end projecting radially from the body substantially no further than the maximum width of the guiding surface leading edges.

11 Claims, 2 Drawing Sheets

EARTH ANCHOR

RELATED APPLICATIONS

Applicant hereby claims priority of co-pending Design application No.: 29/270,187 filed Dec. 19, 2006.

BACKGROUND OF THE INVENTION

1. Field of the Invention

This invention relates to ground anchors, more specifically to pivoting ground anchors.

2. General Background

Ground anchors or earth anchors of the pivoting or tilting type are well known and generally include a main body portion having a leading edge adapted to be forced into the ground, a trailing edge including an outturned lip and a cable or guide wire attachment point intermediate the leading and trailing edges generally positioned from about the mid point of the overall length of the anchor or towards the trailing edge so that upon exerting a force on the cable or attached guide wire after insertion of the anchor into the ground, the trailing edge outturned lip will bite into the earth causing the anchor to rotate or pivot to a locked position generally at a right angle to the withdrawal force. Such anchors have included plate anchors such as shown in U.S. Pat. No. 3,969,854, which are generally difficult to drive into the ground. Those anchors have more recently been replaced with cylindrical or tubular shaped anchors having a bore in the body into which a drive rod can be inserted from the trailing edge to a rod abutment point at or adjacent the bottom or end of the bore. Such anchors, as shown in U.S. Pat. No. 4,044,513, employ outturned lips at the trailing edge generally defining an opening into the interior. Such anchors are also shown in U.S. Pat. No. 4,096,673, both of which are assigned to the assignee of this application. Anchors of that type have been sold by the assignee, Foresight Industries, Inc., under the trademark Duckbill and generally consist of cast cylindrical bodies having a cruciform shaped leading edge, a trailing edge with an outturned lip, a blind bore, and a raised rib at a top side remote from the outturned lip, which has an opening therethrough for receipt of either a shackle, a cable, or another load applying device to initiate rotation and "load locking," i.e. fixing, of the anchor after it is driven into the ground by a drive rod, by means of a hammer, jackhammer, hydraulic press, or the like. Variations on the general shape of such anchors are shown, for example, in U.S. Pat. No. 5,775,037, where the main body may be provided with side edges extending outwardly to the side of the central bore beyond the raised rib. A further variant, shown for example in U.S. Pat. No. 4,802,317, assigned to the instant assignee, utilizes widespread side wings extending laterally of the cylindrical center body portion containing the blind bore. Those lateral wings may have sharpened leading edges and when the anchor is rotated to the locked position the wings increase the contact area between the anchor and the ground providing a wider surface to resist withdrawal of the anchor. Such ground anchors are sometimes referred to as wing anchors. However, the presence of the wings can, in certain instances, can be disadvantageous in that: (a) they provide a much larger area which must be pushed through the ground during insertion of the anchor thereby requiring a higher driving force; and (b) due to their rather large lateral extent with respect to the central body, the force necessary to pivot and lock the anchor is considerably increased. Additionally, (c) the wings can cause a deflection of the anchor during driving. Engagement of an outer reach of the wing with a more drive resistant structure, either a hardened soil structure such as hardened clay or with a stone or rock can have the effect of pivoting the anchor during its driving, which can cause the anchor to change direction as it is being driven into the ground. This can not only result in a mispositioned anchor, it can cause a bending of the drive rod, and in extreme conditions can prevent or hinder withdrawal of the drive rod after the anchor has been placed.

One approach to increasing the straight line drivability of the winged anchors and reducing the driving force necessary is illustrated in U.S. Pat. No. 6,237,289 where the leading edges of the wings are provided with a series of separate chisel leading edges that are stepped back one from another axially and extend for short distances radially thereby providing the leading edges of the wings with a series of separate leading edges that are each longitudinally offset with respect to one another and radially offset with respect to the main body. While this serration or stepping of the leading edges of large wing anchors is an improvement over prior large wing anchors, the necessity for a higher driving force and the difficulties associated with rotation to the locked position remain a problem. Such anchors are therefore used generally only where high load resistance is required, and the more cylindrical anchors are used where lower resistance load levels are anticipated.

The use, however, of cylindrical anchors, with their cruciform driving edges leaves the anchor, during driving, at risk of wandering or deviating from a straight path. Since such anchors are normally driven into the ground at an angle to the vertical, which will represent the angle of the application of load after setting of the anchor, and since the load application is generally at an angle other than 90 degrees, particularly where the anchor is used to anchor a guide wire, a fence end or tree support or the like, it is sometimes difficult to drive the anchor straight. Substantially cylindrical anchors generally have less holding or load bearing capabilities than similar sized winged anchors but are easier to drive and to rotate to a locked position.

It would therefore be an improvement in the art if generally cylindrical ground anchors could be provided with a reduced driving resistance, with a better straight path driving tendency and with improved load bearing capabilities.

SUMMARY OF THE INVENTION

The above advantages are achieved in the current invention by utilizing a substantially cylindrical anchor having a main body portion which is provided with a raised rib extending from an upper surface area of the cylinder, a first flattened plate-like extension projecting forward of the main body terminating in a stepped leading edge, a second generally flat plate-like extension extending forward of the main body projecting normally to the leading edge plate providing guiding surfaces, the second plate terminating at its leading end in a series stepped leading edges. The outermost stepped leading edge on each side of the main body extends beyond the diameter of the main body and forms a leading edge for a short tapered rib which extends along the length of the main body from the rib's leading edge to the trailing edge of the main body and has a width projecting from the main body's outer diameter generally no greater than its leading edge width, which is substantially the same as the leading edge of each step of the guide surface leading edges.

In an embodiment of the invention the anchor comprises a substantially tubular or cylindrical main body section having a generally conical forward or leading end and a trailing edge formed at an obtuse angle to the axis of the body with an outturned lip at the bottom of the trailing edge, a raised rib projecting above the main body portion and having a connector for connection to a tension member, a blind bore extending into the main body from the trailing edge, a leading flat edge member projecting forwardly from the main body loading and terminating in a chisel point, a guide plate projecting laterally of the leading edge projection forward of the main body and the guiding plates having serrated or stepped leading edges on both sides of the leading edge member.

In an embodiment of the invention the anchor comprises a substantially tubular main body section having a generally pointed or sloped forward or leading end and a trailing edge formed at an obtuse angle to the longitudinal axis of the body with an outturned lip at the bottom of the trailing edge, a raised rib projecting above the main body portion and having a connector for connection to a pull member, a blind bore extending into the main body from the trailing edge, a leading edge member projecting forwardly from the main body portion terminating in a chisel point, a pair of guiding plates projecting laterally on each side of the leading edge projection forward of the main body and the guiding plates having serrated or stepped leading edges, the projecting leading edge being formed as a substantially flat plate vertically aligned extending along the axis of the body and terminating in forward stepped chiseled edges, the guide plates terminating at their outermost side edges in ribs extending along the exterior of the main body to the trailing edge, the ribs projecting from the main body approximately the width of one stepped leading edge of the guide surface.

It is therefore an object of this invention to provide a ground anchor having improved drivability requiring the use of minimal drive force and having improved straight line drive tendencies.

It is a further object of this invention to provide a substantially cylindrical or tubular or ground anchor of the pivoting type having improved drivability provided by projecting surfaces extending at an angle to one another projecting forwardly of the main body of the anchor a distance of between 20 and 40% of the overall length of the anchor when measured from the leading end of the main body portion or 10 to 20% of the overall length of the anchor when measured from the end of a transition zone between the end of the main body portion and the projecting surfaces, where the transition zone consists of an axially progressive diameter reduction from an outer diameter of the main body portion to the projecting surfaces, and where the projecting surfaces terminate in leading edges which are pointed or chiseled and which comprise a plurality of leading edge sections which are axially and radially offset from one another in a stepwise fashion, the projecting surfaces having generally flat opposite side surfaces which resist rotation of the anchor about its axis during driving.

It is another object of this invention to provide a generally cylindrical, oval or rectangular body ground anchor having a leading edge defined by chiseled surfaces which are spaced axially and radially from one another and which are formed at the leading edges of generally flat plates projecting forward of the main body portion, the plates being positioned at an angle to one another, and the main body portion having ribs running substantially the length of the main body portion on opposite sides thereof, the ribs having non-blunt leading edges and generally having a width measured outwardly from the surface of the main body portion of about 20% or less of the transverse width of the main body portion whereby the ribs act to assist in straight driving of the anchor without providing significant drag or resistance to rotation.

It is another, and important, object of this invention to provide a generally cylindrical anchor having flat plate-like extensions extending forward of the main body portion terminating in leading edges, the leading edges having stepped back chiseled edges, the outermost chiseled edge on each side of the main body forming the leading edge of a side rib running along the main body to the trailing edge of the main body.

These and other objects will become apparent to those of ordinary skill in the art from a description of the illustrated preferred embodiment, it being understood that this is only one such embodiment of this invention and that many variations in shape and dimension are within the scope of this invention.

BRIEF DESCRIPTION OF THE DRAWINGS

FIG. 6 is a view from the trailing edge head-on.

DESCRIPTION OF THE PREFERRED EMBODIMENT

Figure 2:
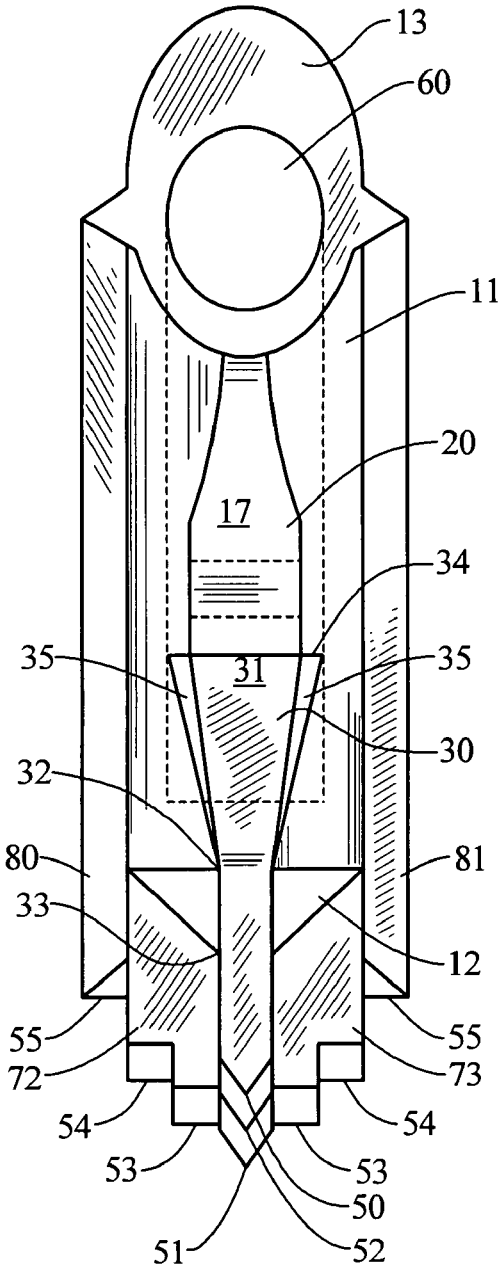
FIG. 2 is a top view of the anchor of FIG. 1.
Figure 1:
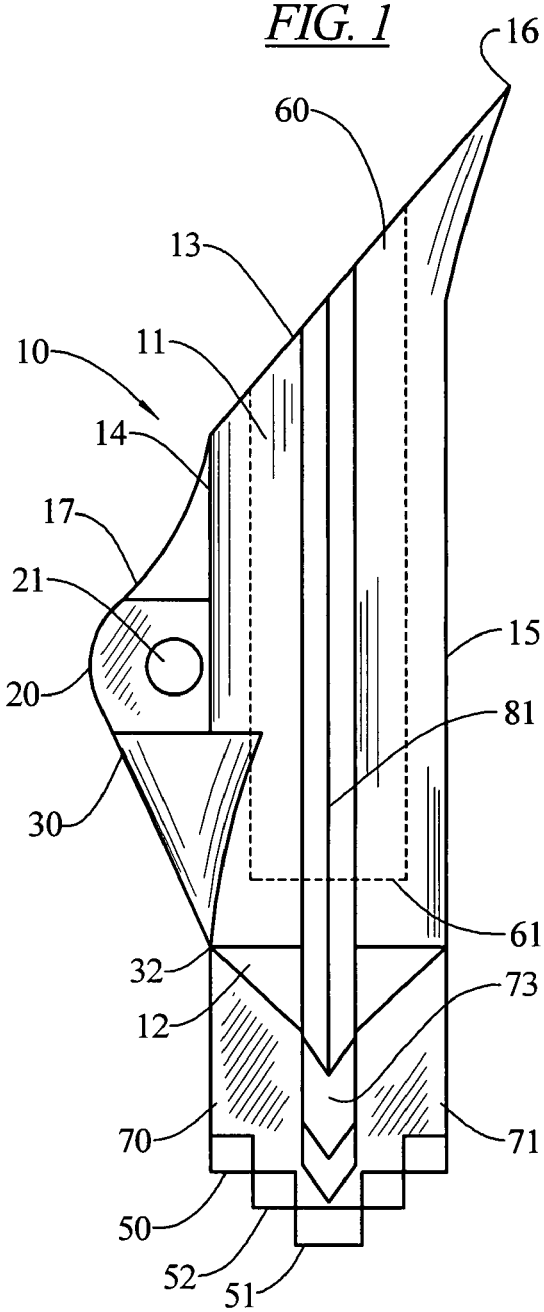
FIG. 1 is a side view of the anchor of this invention.

As shown in FIGS. 1 and 2, the anchor 10 of this invention consists of a generally cylindrical main body portion 11 which may have a generally conical leading end 12 and a trailing end 13 formed at an oblique angle to the longitudinal axis of the main body. The trailing end 13 incorporates at a bottom 15 of main body 11 an outturned lip 16 which will bite into the soil surrounding the anchor after it has been driven to its desired depth and a withdrawal load is applied. A rib 17 is formed on a top 18 of the main body 11, and in the embodiment illustrated, includes a projecting central section 20 projecting furthest from the top 18 of any portion of the main body, that section 20 being provided with an opening 21 extending transversely therethrough.

The opening may have a cable threaded through it and clamped back on itself or may provide a fixture point for a shackle to which a cable or a rod may be attached. Numerous other fixture examples for attaching the anchor wire or rod to the raised rib are known and can be substituted for the bore 21. These include T-shaped slots which can receive a T-shaped head on an anchor rod, or openings extending entirely through the anchor from the top surface 18 to the bottom surface 15 having a smaller opening in the rib area than at the bottom so that a headed rod may be fed through the anchor from the bottom with the rod extending outwardly from the rib and the head pivotal in the opening and being retained therein by the smaller opening at the top of the rib. These are all matters of design choice and are known to the art.

Similarly the conical shaped leading end of the main body portion may be formed as flat, sloping surfaces, abrupt end walls or otherwise shaped. A sloped or angled wall, whether formed as a portion of the cone or flat triangular sections having surfaces at an angle to the longitudinal axis can be beneficial in comparison to a blunt radial surface as the anchor is being driven into the ground inasmuch as such surfaces will push the soil away from the main body 11 behind them.

Similarly the leading top surface 30 of the raised rib 17 is preferably formed at an angle to the longitudinal axis leading from the outer diameter surface of the main body portion at its forward end 32 to the central section 20 at an attack angle facilitating movement of the soil. The embodiment shown in the figures provides a flat top surface 31 which increases in width from its inter section with the top leading end 32 of surface 18 of the main body portion at the start of the conical section 12, the increase in width extending backwards to a point forward of the section 20. The section 20 is of a smaller width, transverse the longitudinal center line of the main body so as to produce an abrupt width reduction at 34 between the leading portion of the rib and the attachment portion 20. The side wall 35 of the rib extending from the flat top 31 may flare out linearly or, as shown in this embodiment, in a more rounded fashion, the shape of these surfaces being a matter of design choice.

While I have shown an anchor having a flat surface 31 at the leading face of the rib, it will be appreciated that an edged surface which rises to a central peak and which may extend all the way back from the leading edge point 50 of the anchor to the section 20 may be desired to facilitate penetration of the anchor into the soil.

It is, however, desired that the leading edge of the raised rib be configured to direct soil away from the section 20 since the cable, shackle, rod end or the like may extend out of the side of the rib section 20 causing a resistance to ease of passage of the anchor into the ground.

Because the rib is raised from the main body, and because it provides the anchoring attachment point for the cable, rod, etc. which will be under tension when the anchor is being pivoted and when it is providing its anchoring function, the rib must be strong enough to accommodate such load forces without separation from the remainder of the anchor. To that end, such ribs are relatively large and are a factor in the tendency of the anchor to deviate from a straight course as the anchor is driven into the ground. A blind bore 60 extends into the main body from the trailing edge and terminates in a driving surface 61 at or adjacent and end of the blind bore. The end may be squared as shown or may be radiused to prevent mushrooming of the tip of the drive steel. An elongated drive steel is inserted into the bore 60 and is used to drive the anchor into the ground by force application means, which, depending upon the size of the anchor, may range from a handheld hammer to a substantial piece of machinery similar to a pile driver. Since the depth of insertion of the anchor into the ground will be dependent upon anchor size, load to be retained, soil quality, and the like, the drive steel may be quite long, be constructed of threaded together sections and may not itself be structurally sufficient to ensure that the anchor drives straight.

While it has been known to provide cruciform projections extending from the leading end of the main body to assist in penetration of the soil for substantially cylindrical rotating anchors, such extensions have not proven to be wholly satisfactory in preventing wandering or other than straight line movement of the anchor during driving. For winged anchors, which have relatively large side wings projecting from the central body, cruciform chiseled projecting edges and sharpened winged edges have been utilized such as shown in U.S. Pat. No. 5,031,370. Moreover, such anchors have been provided with serrated or stepped leading edges in both the vertical, top to bottom, orientation and the horizontal, side-to-side wing-to-wing, orientation. While these leading edges have benefits in winged anchors they have not been used on substantially cylindrical or elliptical bodied non-winged anchors.

Figure 4:
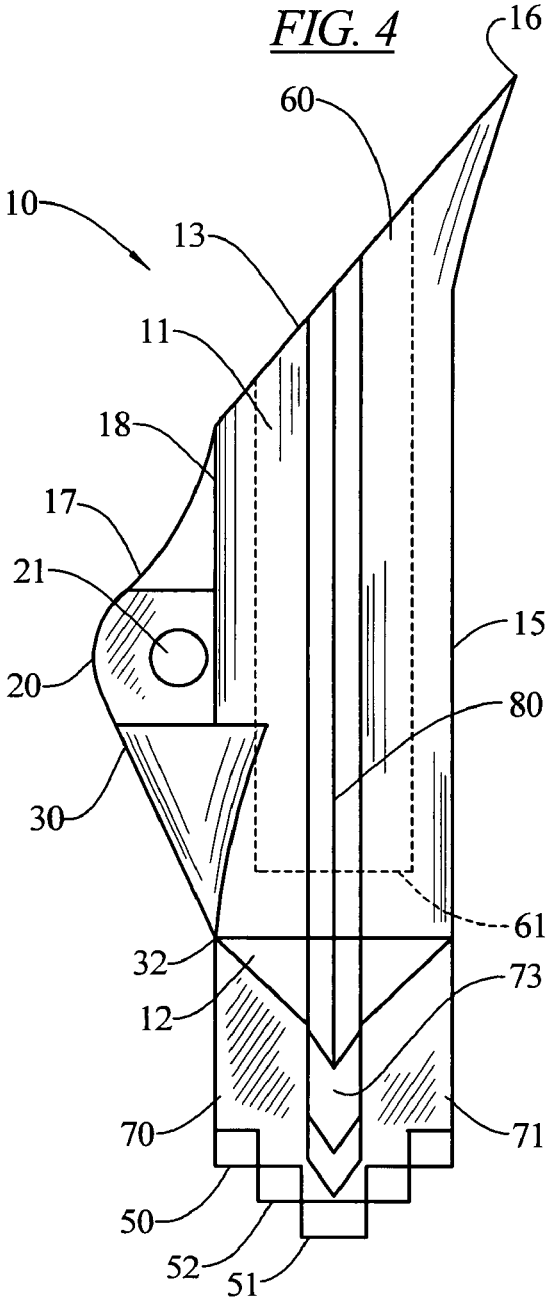
FIG. 4 is a view of the anchor of FIG. 1 from the other side.
Figure 5:
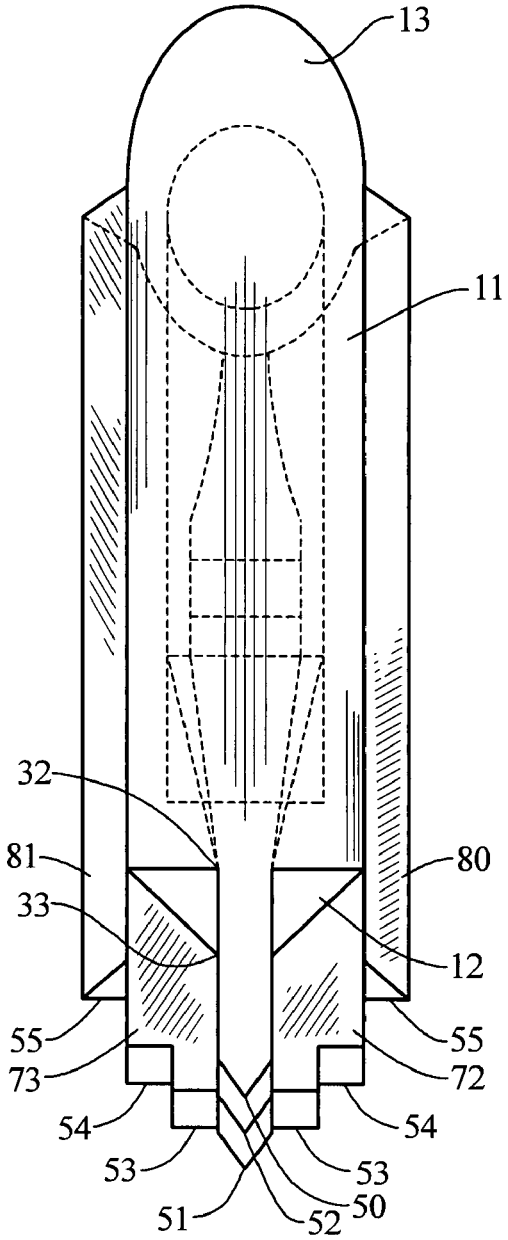
FIG. 5 is a view of the anchor from the bottom.

This invention provides leading plates 70, 71, 72, and 73, or projecting surface members, which extend forward of the main body, which are positioned at an angle to one another, generally at right angles, and which provide leading edges 50, 51-55. The plate 70 extends forward from the juncture 32 of the raised rib and terminates in stepped leading edges 50, 52 and 51, with 51 being centrally located. Each of the edges is chiseled forming a piercing tip. The plates 70 and 71 may be considered as one plate and the plates 72 and 73 as a second plate, with the two plates intersecting or, for purposes of description, the plates may be considered as four separate plates extending radially from a common junction. A greater or lesser number of plates can be provided and although the plates 72 and 73 are shown as having their leading edges 53 spaced axially behind the leading edge 51 of plate 70-71, it will be understood that the two plates could extend an equal amount forward of the main body as shown in FIG. 4. Preferably the plates provide anti-rotation surfaces resisting rotation of the anchor during driving. To this end the plates extend approximately ⅓ of the overall distance of the anchor when the beginning point of the plate is measured from the point 32 representing the forward end of the main body 11 prior to the conical or transition zone 12. When measured from the end of the transition zone 12 the plate will extend approximately 20% of the overall length of the anchor. While these percentages may be varied, it is preferred that when measured from the point 32 the plates extend between 20 and 40% of the overall length, and when measured from the point 33, being the end of the transition, the plates project forward from 15 to 25 percent of the length. This provides a sufficient anti-rotation surface to aid in straight driving of the anchor. While the top and bottom surfaces of the plates 70-73 may be formed parallel to one another, they may also lie at an angle. The plate 71 is the mirror image of the plate 70 positioned on the other side or bottom side of the anchor, the plates 70 and 71 being separated by horizontal plates 72 and 73, which project similarly from the juncture of the main body portion with the conical shaped section 12 and are mirror imaged left and right. The plates 72, 73 may terminate in setback, chiseled edges 53, 54 or may, if desired, have a more central edge extending to the tip 51, although it is my preference to have a single leading chiseled edge 51. Although I have shown an X shaped or cruciform shaped leading edge consisting of four plates lying at right angles to one another equally spaced, it will be understood that other combinations may be utilized. For example, the bottom plate 71 could be eliminated such that the forward projection would be substantially T-shaped. It will be appreciated that the plate 70 cannot be eliminated as easily since it blends back into the raised rib. Although I have chosen to describe the forward extensions as plates, or as plate-like members, this is for descriptive purposes only being understood that the entire anchor may be formed as a single casting, that the extensions may have a cross sectional curvature to them or may project upwardly or downwardly adjacent their outmost edges. It will further be understood that the top surface of the plate 70 or the bottom surface of the plate 71 or the sides of plates 72 or 73 may be chiseled. I use the term chiseled to include all forms of sharpened edges including those having a radius at their outermost point. It is not intended that the chiseled surfaces by knife sharp and dangerous to handle, however the surfaces should not be blunt to the full thickness of the plate.

Figure 3:
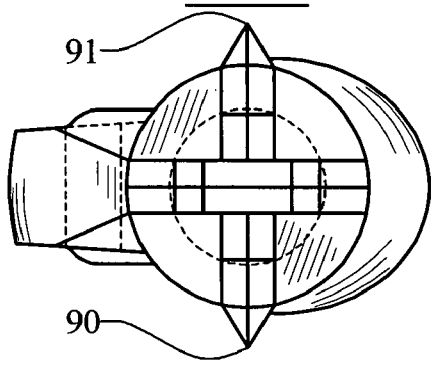
FIG. 3 is a leading edge head-on view of the anchor of this invention.
Figure 6:
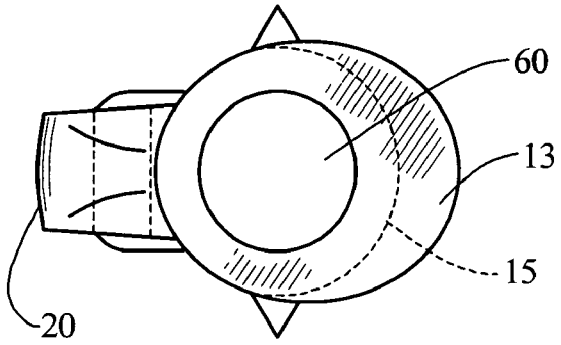

Additionally, at the outer edges of plates 72 and 73 and spaced from the last setback leading edge 54, ribs 80 and 81 are positioned on each side of the main body, the ribs may have substantially triangular shaped chiseled leading edges 55 which terminate at the outer edge of the ribs, the outer edge being chiseled or pointed as shown at 90, 91 of FIG. 3. The leading edges 55 and the ribs 80, 81 have a width from the outer diameter of the main body which is relatively small, preferably about 20% of the diameter of the main body 11. These ribs are not designed to act as wings such as is found in the winged anchors but instead counteract the tendency of the raised rib to turn the anchor from a straight path during driving. By extending the ribs 80, 81 the full length from before the leading end of the transition section 12 to the trailing edge 13 of the main body, by maintaining the ribs relatively narrow, and by making them V-shaped in cross section, they do not add significantly to the drag of the anchor as it is being driven into the soil but do act to facilitate straight driving of the anchor. It will be appreciated that the force of soil acting against the leading surface 30 of the raised rib will have a tendency to cause the anchor to pivot upwardly at its front or will push the entire anchor downwardly as it is being driven into the ground. The ribs 80, 81 are intended to aid in resisting that tendency without adding significant resistance to the driving of the anchor into the ground.

Although I have shown a preferred embodiment having only two ribs which are aligned with the center line of the longitudinal axis of the anchor and which start from the edges of the plates 72, 73, others may choose to use this invention by providing, for example, two ribs per side or positioning the rib higher or lower along the sides of the main body, therefore not being planer with plates 72, 73.

I have also chosen to use relatively flat plates 70-73 to define the extension projecting forward of the main body of the anchor since those flat surfaces also act to resist wandering of the anchor. Others may decide on different shapes or sizes for the projecting features, for example the plates rather than being of uniform thickness can be thinner at the front and increase in thickness towards the main body portion.

Moreover, where I have shown the leading edges 50-54 and 55 to lie at substantially right angles to the longitudinal axis of the anchor, such edges may be angled backwardly if desired.

These and other modifications of this invention will be readily apparent to those of ordinary skill in the art. For example, although I have shown and described the anchors as being substantially cylindrical or elliptical, the anchor body could be rectangular, octagonal or otherwise. In general, when I use the term "substantially cylindrical" I intend to encompass all such minor shape variations.

I claim as my invention:

1. An earth anchor comprising a substantially cylindrical main body having leading and trailing ends and a top and bottom, a longitudinal axis, an outturned lip at the trailing end, a raised rib extending from a top of the main body portion radially outwardly thereof having a leading surface and defining an attachment point for attachment of a tension member, at least one first generally plate-like member extending from a leading end of the main body terminating in the leading edge spaced from the main body and having top and bottom edge surfaces, the leading edge comprising a plurality of individual chiseled edge sections stepped back towards the main body from an adjacent axially outwardly positioned edge section and extending substantially normal to the longitudinal axis outwardly from the adjacent edge section, the stepped back edge sections lying to either side of a plane parallel to a longitudinal plane intermediate the top of the main body from which the rib projects and a bottom of the main body lying opposite the main body from the rib, the first generally plate-like member having a top edge surface extending from the radially outermost chiseled leading edge back towards the main body aligned with a leading surface of the raised rib, at least one rib lying on each side of the main body intermediate the top and bottom extending from at least the leading end of the main body to the trailing end of the main body, the side ribs being substantially V-shaped in cross-section normal to the longitudinal axis and each having a single chiseled leading edge.

2. The anchor of claim 1 including a second generally plate-like member extending from the leading end of the main body and terminating in a series of chiseled leading edges lying to each side of the first generally plate-like member with the chiseled edges on each side of the second generally plate-like member being spaced axially and radially from one another as the edges increase in distance from the first plate-like member.

3. The anchor of claim 2 wherein the innermost leading edge of the second generally plate-like member extends radially outwardly from the first plate-like member and is positioned axially behind a leading edge of the plate-like member.

4. The anchor of claim 2 wherein the innermost leading edge of the second generally plate-like member extends from the first generally plate-like member and projects from the main body a distance approximately the same as the distance of projection from the main body of the furthest leading edge of the first generally plate-like member.

5. The anchor of claim 2 wherein the side ribs are coplanar with the second generally plate-like member.

6. The anchor of claim 5 wherein the side ribs have their leading edges positioned forward of the main body.

7. The anchor of claim 2 wherein an angled transition zone is provided between the leading end of the main body and the plate-like members, the transition zone terminating at a position spaced behind the leading edges of the plate-like members and forming an angled surface for deflecting material away from the leading end of the main body as the anchor is pressed into the ground.

8. The anchor of claim 7 wherein the transition zone is partially conically shaped.

9. An earth anchor of the substantially cylindrical body tilting type comprising an anchor body having leading and trailing ends with a blind bore extending into the body from the trailing end, a portion of the trailing end defining an outturned lip adapted to bite into the soil adjacent the trailing end after the anchor has been driven into the ground when a tension force is applied to the anchor to withdrawal from the ground, the anchor body having a raised rib projecting from it on a side of the anchor body opposite the outturned lip, the raised rib defining an attachment point for attachment of a tension member, the body having a pair of projecting plates extending forwardly of the leading edge of the body, the plates lying at an angle to one another and being joined to one another at an intersection, each of the plates having leading edges and each of the leading edges being defined by a series of stepped back chiseled edges stepped back from a central chiseled edge to either side of the central chiseled edge, an angled surface transition zone between the leading end of the body and the leading edges of the plates deflecting material from the plates away from the body during insertion of the anchor into the ground, ribs on opposite sides of the body extending substantially the length of the body, the ribs each having a height from a top to a bottom and a chiseled leading edge terminating intermediate the top and bottom and a substantially V-shaped outer edge spaced from the body, the ribs projecting from the body to a distance approximately 20% or less of the width of the body.

10. The anchor of claim 9 wherein the ribs have leading edges positioned ahead of the body, the leading edges being chiseled.

11. The anchor of claim 9 wherein at least one of the plates extends from the leading end of the body by about 30 to 35% of the overall length of the anchor.

* * * * *